US010151147B2

(12) United States Patent
Juvani

(10) Patent No.: US 10,151,147 B2
(45) Date of Patent: Dec. 11, 2018

(54) METHOD FOR STEERING A DIRECTION OF A DRILLING DEVICE DRILLING A HOLE INTO THE GROUND

(71) Applicant: GEONEX OY, Ylitornio (FI)

(72) Inventor: Kimmo Juvani, Ylitornio (FI)

(73) Assignee: GEONEX OY, Ylitornio (FI)

( * ) Notice: Subject to any disclaimer, the term of this patent is extended or adjusted under 35 U.S.C. 154(b) by 171 days.

(21) Appl. No.: 14/910,371

(22) PCT Filed: Aug. 5, 2014

(86) PCT No.: PCT/FI2014/000018

§ 371 (c)(1),
(2) Date: Feb. 5, 2016

(87) PCT Pub. No.: WO2015/018969

PCT Pub. Date: Feb. 12, 2015

(65) Prior Publication Data

US 2016/0177628 A1 Jun. 23, 2016

(30) Foreign Application Priority Data

Aug. 5, 2013 (FI) ..... 20130224

(51) Int. Cl.
*E21B 7/06* (2006.01)
*E21B 4/16* (2006.01)
*E21B 6/00* (2006.01)

(52) U.S. Cl.
CPC ..... *E21B 7/067* (2013.01); *E21B 4/16* (2013.01); *E21B 6/00* (2013.01)

(58) Field of Classification Search
CPC ... E21B 7/067; E21B 6/00; E21B 4/16; E21B 7/062; E21B 7/068
See application file for complete search history.

(56) References Cited

U.S. PATENT DOCUMENTS 4,319,649 A 3/1982 Jeter
5,002,138 A * 3/1991 Smet ..... E21B 4/02 175/107

(Continued)

FOREIGN PATENT DOCUMENTS

EP 0369030 A1 5/1990
GB 2425791 A 11/2006

(Continued)

OTHER PUBLICATIONS

The Supplementary European Search Report dated Feb. 7, 2017, for International Application EP 14 83 4243.

(Continued)

*Primary Examiner* — Brad Harcourt
(74) *Attorney, Agent, or Firm* — Avery N. Goldstein; Blue Filamant Law PLLC

(57) ABSTRACT

Method for controlling the direction of a drilling device which drills a hole into a ground wherein a hammering and rotatable bit (3) is used as the drilling bit and the device comprises coupled with the bit (3) a hammering device (2) behind the bit (3) and a drill arm which is potentially related to it wherein the rear part (15) of the hammering device or the drill arm locates in the drilled hole or inside a casing tube (1) which covers the drilled hole in a free space so that there is space for the mentioned rear part (15) to move in the direction of the radius of the drilled hole and that the location of the bit (3) in the ground during the drilling is observed on the grounds of the data received from the position sensors which indicate the location of the bit (3), characterized in that in the method the direction of the drilling is steered by adjusting only the position of the mentioned rear part (15) in relation to the center line (C) of the drilling by organizing a support, which is deviated from the center line (C) or located on the center line (C), for the mentioned rear part (15) with the help of a support element (Continued)

(5, 5', 7) which is located in the drilled hole or at the inner surface of the casing tube (I) which support is adjusted at the feed end of the drilling device and wherein a direction angle (a) is formed only for the bit (3) and hammering device in relation to the mentioned center line (C).

10 Claims, 3 Drawing Sheets

(56) References Cited

U.S. PATENT DOCUMENTS

| | | | |
|---|---|---|---|
| 5,220,963 | A | 6/1993 | Patton |
| 5,547,031 | A | 8/1996 | Warren |
| 6,808,027 | B2 | 10/2004 | McLoughlin |
| 2002/0011359 | A1 | 1/2002 | Webb et al. |
| 2002/0185315 | A1 | 12/2002 | McLoughlin |
| 2007/0187150 | A1 | 8/2007 | Walker |

FOREIGN PATENT DOCUMENTS

| | | | |
|---|---|---|---|
| JP | H0220789 | A | 1/1990 |
| JP | H08291681 | A | 11/1996 |
| JP | 2871697 | B2 | 3/1999 |
| WO | 00/55468 | A1 | 9/2000 |
| WO | 0055468 | A1 | 9/2000 |

OTHER PUBLICATIONS

English translation of Japanese Notice of Reasons for Rejection dated Jun. 12, 2018 for Japanese Application No. 2016-532708 filed Apr. 1, 2016.

* cited by examiner

D - D

METHOD FOR STEERING A DIRECTION OF A DRILLING DEVICE DRILLING A HOLE INTO THE GROUND

Invention relates to a method for steering the direction of a drilling device drilling a hole into a ground wherein a hammering and rotatable bit is used as the drilling bit and the device comprises coupled to the bit a hammering device behind the bit and a drill arm potentially belonging to it wherein the rear part of the hammering device or the drill arm locates in the drilled hole or inside a casing tube in a free space which casing tube coats the drilled hole so that the mentioned rear part has space to move in the direction of the radius of the drilled hole and that the location of the bit in the ground during the drilling is observed on the grounds of the data received from the position sensors which indicate the location of the bit.

A solution as a control method of the direction of a drilling device is previously known from the publication EP 0369030 in which solution the front end of the drilling device is formed to be two successive, cylindrical units which units are connected with each other so that they form a little angle. The units can be bent due to the joint construction in the desired direction with the help of power units, such as hydraulic cylinders so that the whole unit starts to turn in this direction.

The disadvantage of this above described method is the fact that it is suitable mainly only for controlling the direction of the drillings which are performed into a soft ground. The foremost cylinder part can be turned for the control only in a ground which gives in enough so that this part can be turned in relation to the latter part. In a rock hole this turning is successful only in the case where a hole which has a clearly larger diameter than what the needed cylinder parts, which are needed for the control, are regarding their diameter, is being drilled with the bit. Additionally this method requires either hydraulic pipeworks or an electric cable which can be directed to the drill head and several power units which are related to the turning. Also the location of the drill head needs to be observed so that the alignment of the drill head can be performed.

Methods for controlling the direction of the drilling device are further known also from the publications US 20070187150, U.S. Pat. No. 6,808,027 and U.S. Pat. No. 4,319,649. In these publications the drilling devices are cutting drills which drill a hole into the ground with which cutting drills one drills downwards and no impacts are directed to the bit. For example oncoming stones can cause angular deviations for the drilling devices. The drill rods are supported at the wall of the hole at several locations but the orientation of the bit at the head is not aimed to be turned with the help of the control of the direction in relation to the centre line of the drill rod, in other words one does not aim to create an angle between these directions. But the bit is being moved sideways and also the drill rod is being moved sideways with the help of several successive, adjustable support elements.

In order to eliminate the disadvantages of the methods described above a new control method of the direction of the drilling device is developed for such a drilling device which drilling device comprises a hammering device behind its bit and a potential drill arm which belongs to the bit in which case the rear part of the hammering device or the drill arm is located in the drilled hole. With the invention an essential improvement is achieved in relation to the existing prior art and it is characteristic of the method according to the invention that in the method the drilling direction is controlled by adjusting only the position of the mentioned rear part in relation to the centre line of the drilling by arranging a support, which is deviated from the centre line or is located on the centre line, for the mentioned rear part with the help of a support element by using the drilled hole or the inner surface of the casing tube which support is adjusted at the feed end of the drilling device and wherein a direction angle is formed only for the bit and for the hammering device in relation to the mentioned centre line and that the impact which is directed to the bit is formed at the front side of the mentioned support element and that the impact is directed in the direction of the bit a into the surface to be drilled.

The advantage of the method according to the invention that it is suitable for ground drilling as well as for drilling a hole into a rock when the alignment of the bit and a minor turning into deviating angle related to it can be performed inside the drilling device. The bit of the drilling device which bit is located exactly at the very drill head turns only a little and the percussion hammer which is located behind the bit and a potential drill arm turn in a free space inside the casing tube or in the rock hole. Support elements can easily be made for the rear part of the percussion hammer or the drill arm with the help of which the rear part can be kept either on the centre line of the drilling or in an angle position which deviates from it. The percussion hammer hammers the bit always in an efficient hammering direction without losses even though the bit would be turned in relation to the centre line of the drilled hole.

In the most advantageous implementation method of the invention the drill head does not comprise power units which are related to the control and does not comprise pipework or cabling when the functions related to the alignment can be performed at the feed head of the drilling device, at the ground surface with an axial movement of the drill rod and with the help of a rotation or just by using the rotation in which case one can rotate the drill rod and/or the casing tube.

In the following the invention is described more detailed by referring to the accompanying drawing in which FIG. 1 shows a drilling device as a side view.

Figures 1, 2, 3:
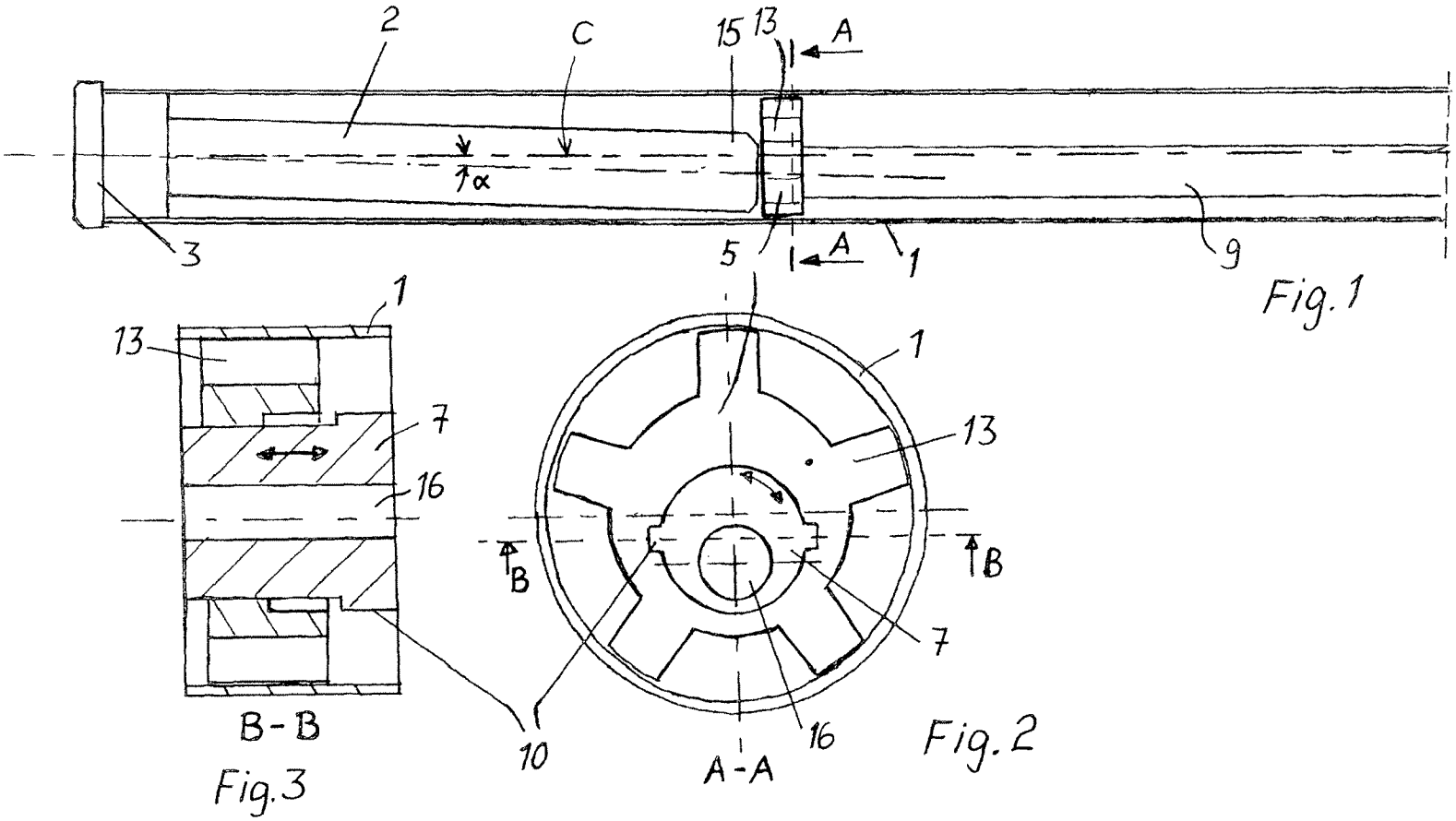
FIG. 2 shows a section from the FIG. 1 from the line A-A.
FIG. 3 shows a section from the FIG. 2 from the line B-B.

FIG. 1 shows as an example a drilling device which is equipped with a casing tube 1 which drilling device comprises the drilling bit 3 and a percussion hammer 2 behind it, a rear part 15 of the percussion hammer 2 to which rear part a drill rod 9 is directed from the start, in other words the feed part of the drilling in such a way that pressurized air flows along the drill rod 9 for the percussion hammer 2 and a rotating movement comes along the drill rod for the hammer and for the bit 3. There are support elements 5,7 at the intersection of the drill rod 9 and the rear part 15 of the percussion hammer 2 with which support elements the position of the drill rod 9 and the rear end of the hammer 2 is adjusted inside the casing tube 1.

FIG. 2 shows a structure of a support element which structure comprises the first support element 5, which moves along the casing tube 1 inside the casing tube 1 during the drilling, which is located inside the casing tube 1 and rotates inside it. The first support element 5 comprises wings 13 with the help of which wings it rests on the casing tube 1 if the casing tube is used or it rests on the rock hole and slides on the inner surface of the hole if the casing tube 1 is not being used. The first support element 5 further comprises a hole which is located out of centre into which the second rotatable part 7 is located the rotation of which part can be locked to the first support element 5 with the help of a shoulder arrangement 10. FIG. 3 shows how the locking occurs with the help of the shoulder arrangement 10 when the second support element 7 moves in axial direction in relation to the first support element 5. The rotation of the hammer 2 and the bit 3 coming through the drill rod 9 occurs through a hole 16 which belongs to the second support element 7 through which hole the drill rod 9 is directed to the hammer 2.

In the implementation method of the FIGS. 2 and 3 the drill rod 9 always rotates one support element 7 and there are two locking positions for the other support element 7 to the first support element 5. With the help of the axial movement of the second support element 7 which movement can be created by pulling and/or pushing the drill rod 9, the second support element is opened and locked from the locking shoulder 10 in which case with the help of the rotation of the drill rod 9 and with the help of the axial movement occurring after it the second support element 7 can be locked into the position according to the FIG. 2 in the first support element 5 or into a position which is turned 180° from it. If the drill rod is pulled back in order to create the axial movement at the location of the support elements and so that the bits/a bit 3 would not be pulled at the same time, there can be the needed sliding distance in an axial direction between the pilot bit and the broaching bit in the locking position or a corresponding sliding distance between the pilot bit and the percussion hammer 2.

In the position according to the FIG. 2 the hole 16 is located considerably out of centre in the casing tube 1. In the position which is turned 180° from it the hole 16 is located at the centre of the casing tube 1. When the drill rod 9 goes through the hole 16 to the rear part 15 of the hammer 2, the rear pan of the hammer 2 will analogously be located either considerably out of centre inside the casing tube 1 or it will be located exactly at the centre of the casing tube 1. The drilling in this example is controlled either when the position of the hole 16 is moved to the centre of the casing tube 1, in which case the drilling proceeds without any controlling action and in which case it should proceed in a linear way or the drilling is being controlled when the position of the hole 16 is being moved to be out of centre in relation to the casing tube 1 in which case the drilling is being deviated for the amount of the angle $\alpha$ from the linear direction.

In the case shown in the FIG. 2 which is described above the first support element 5 rotates during the drilling and it cannot be locked to be non-rotatable. When one wants to control the drilling direction, the hole 16 must be located in an out of centre position in relation to the casing tube 1, such as in the FIG. 2 and in this position the second support element 7 must be locked to the first support element 5. With the help of the rotation which is coming from the drill rod 9 both support elements 5 and 7 rotate and the hole 16 starts to rotate in a circular orbit and analogously the rear part 15 of the percussion hammer 2 starts to rotate in a circular orbit. The drilling device starts to turn in the desired direction if the rotation is slowed down with the help of the drill rod 9 or the impact of the hammer is boosted when the hole 16 is located in the opposite area in relation to the centre line C than in which direction one wants the drilling to be turned (in the FIG. 1 the drilling turns upwards).

Control of the drilling requires that one knows the position of the drill head in relation to the desired drilling line and that one knows the direction 0-360° in which the drilling direction should be turned if there is a need for the turn. In addition to this one needs to know when the hole 16 is located in the angle area in relation to the centre line C of the drilling in which the rotation of the drill rod 9 must be slowed down or the impacts must be boosted. The underground position of the drill head can be found out with the known methods by locating the known positioning equipment and a transmitter at the drill head and by receiving location data sent by the transmitter with the help of a receiver which is located ground surface. The same equipment and the transmitter can also indicate each angle position of the hole 16. In this implementation method the percussion hammer 2 is located at the drill head. An alternative can also be that the drill rod 9 conveys the impacts from the starting end in which case there is for example a drill arm behind the bit 3 the rear end of which drill arm is controlled with the help of the support elements.

Figure 4:
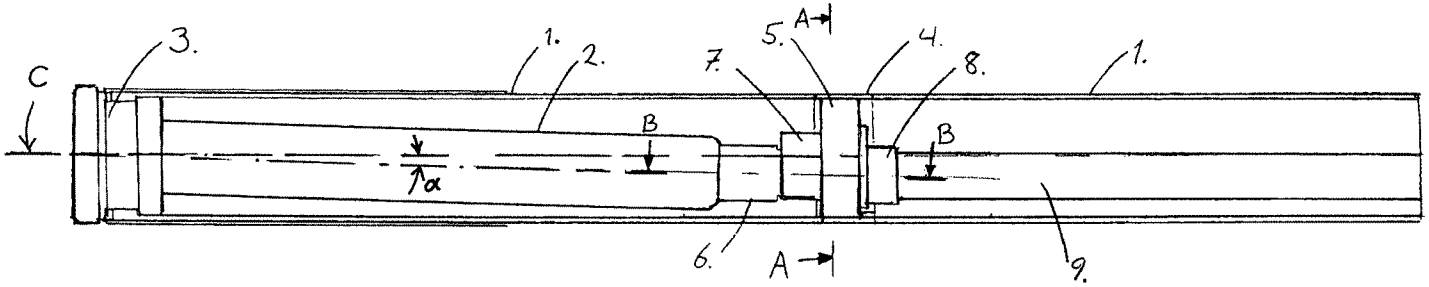
FIG. 4 shows an alternative drilling device as a section view and as a side view.
Figure 5:
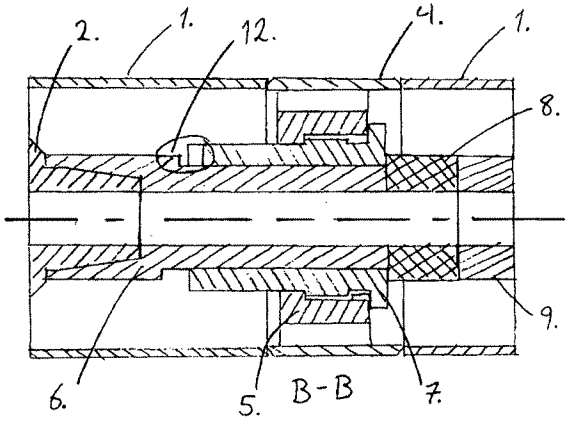
FIG. 5 shows a section from the FIG. 4 and a section from the line B-B.
Figure 6:
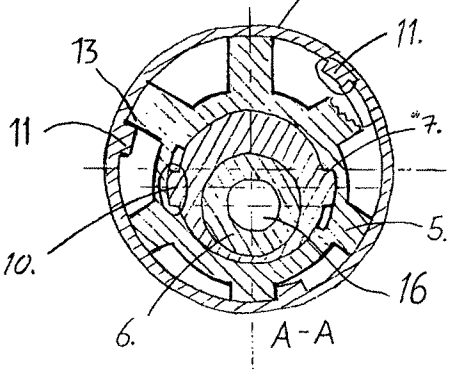
FIG. 6 shows a section from the FIG. 4 from the line A-A.

In the FIG. 4 the first support element 5 is shown for which support element a ring 4 is welded inside the casing tube 1 which ring stays quite accurately at the location of the first support element 5 during the drilling. Ridges 11 which are directed inwards are formed on the inner surface of the ring 4 with which ridges the rotation of the first support element 5 can be prohibited if the mentioned support element 5 is moved in an axial direction so that its wing 13 moves behind the ridge 10. The hole existing in the first support element and which is for the second support element 7 is located out of centre in relation to the casing tube 1. Between the first 5 and the second support element 7 there is also a locking to be opened/closed occurring with their mutual axial movement. FIGS. 5 and 6 show these lockings 10 and 11. FIG. 5 further shows a locking 12 in which case by pulling the drill rod 9 first a little bit back the support element 7 will be organized to have a rotational connection with the sleeve part 6 with the help of the locking 12 which sleeve part is otherwise adjusted to rotate freely in the inner hole of the support element 7. A spring element 8, which is attached to the end of the drill rod 9 and which allow minor angle differences between the drill rod 9 and the sleeve part 6 and at the same time transmits the rotating movement, is also shown in the FIG. 5.

FIG. 6 shows the lockings 10 and 11 which both can be opened by pulling the drill rod 9 back and can be locked by pushing and rotating the drill rod 9 till the shoulders hit each other for transmitting the rotating power. The lockings 10, 11, 12 can also be antiparallel wherein they can be opened by pulling the casing tube 1 backwards.

Controlling of the drilling device of the FIGS. 4-6 occurs with the help of an out of centre support for example by rotating the casing tube into such angle position that the centre of the hole 16 according to the FIG. 6 and at the same time the centre of the rear part 15 of the percussion hammer 2 and the centre of the sleeve part 6 are in the tight, out of centre angle position regarding the correction of the direction and sleeve part 6 is in a freely rotating position inside the support element 7 and the first support element 5 is locked to be non-rotatable in relation to the casing tube 1 when its wing part 13 is located behind the shoulder 11 of the inner surface of the casing tube.

Drilling which is meant to proceed directly is for its part performed by rotating the second support element 7 180° from the position of the FIG. 6 in which case the sleeve part 6 moves to rotate on the centre line C of the casing tube 1.

In one embodiment the support element of the FIGS. 2 and 6 is attached for example by welding it to the casing tube 1 in which case it does not rotate during the drilling. The location of the hole 16 which is inside the support element 5 can be organized to be out of centre by rotating the second support element 7 inside the support element 5. In this case the location of the hole 16 can be adjusted into various angles of rotation by rotating the casing tube 1 till the hole 16 is located in the desired angle position.

Figure 7:
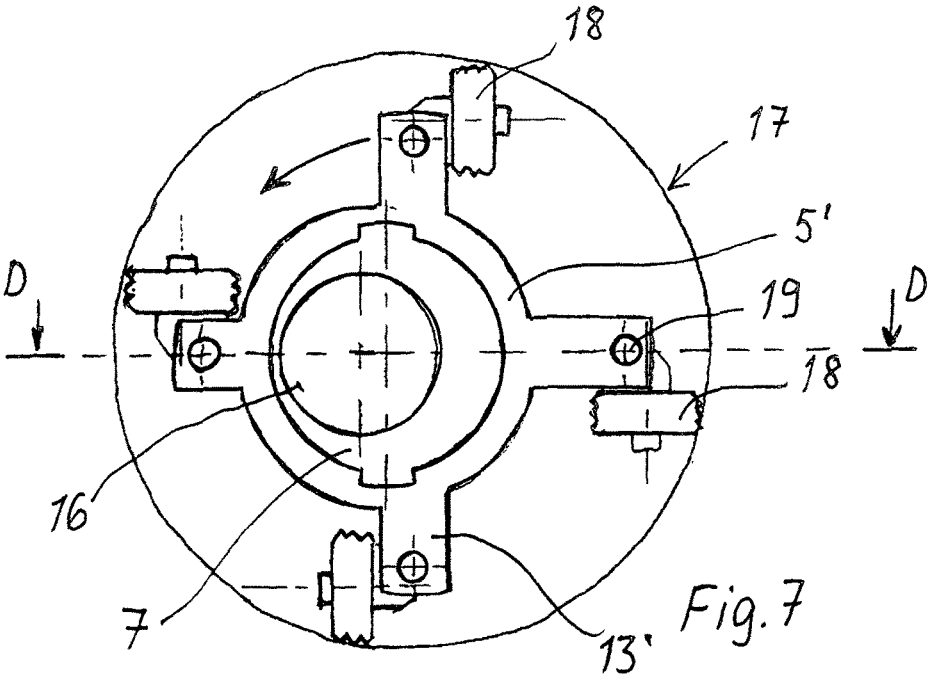
FIG. 7 shows a support element which rests on a rock hole.
Figure 8:
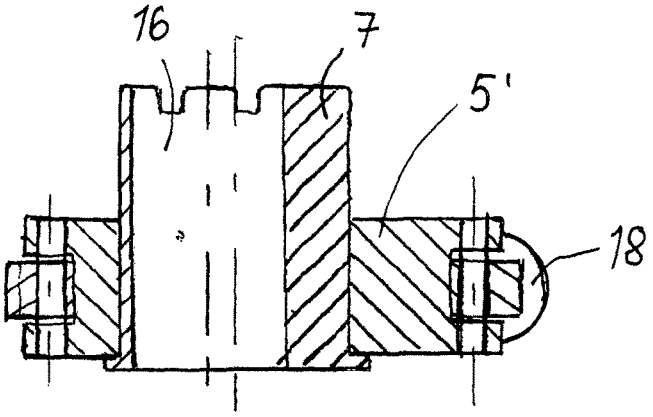
FIG. 8 shows a support element from the FIG. 7 as a section view from the line D-D.

Wheels 18 which are attached with joints 19 and are adjusted to the wing parts of the first support element 5' are shown in the FIGS. 7 and 8 which wheels become pressed onto the inner surface of the rock hole 17 when the support elements 5' and 7 are being rotated clockwise and lock the support element 5' to be non-rotatable but enable the fact that the support element 5' can easily proceed in the rock hole. When the support elements 7, 5' are being rotated in the direction of the arrow counterclockwise, the wheels 18 stop being pressed against the surface of the hole 17 and with the help of the drill rod 9 the support element 5' can be rotated counterclockwise into the desired, new angle position. Then the control is adjusted only with the rotation of the drill rod.

With the method according to the invention one can control drillings which are directed in various directions and the drilling can be directed also during the drilling by changing the rotating speed or the impact energy of the hammer when the rear part of the drilling device is deviated from the centre line of the drilling and the impact direction is in the desired angle area. The drilling direction is changed by deviating the impact direction from the centre line of the drilling device by moving the centre of the rear part of the drill head away from the centre line of the drilling device.

There may be changes made for the method at the bit part of the drilling device. When the percussion hammer is turned a little bit from the drilling direction, then the pilot bit which is attached to the hammer usually turns along with it and there are no problems with the impact surface but if there will be an angle difference between these, the impact surface may for example be a spherical surface with a large radius. In the case in which a ring shoulder, which is meant for transmitting impacts and pulling the casing tube, is possibly attached to the pilot bit, this shoulder or its counter surface does not turn and in these cases impact surfaces which have a curvilinear form can also be used.

Even though the examples are limited only in the cases where the rear part of the percussion hammer or the drill arm is moved only with an out of centre principle, the moving of the rear part can also be performed with many other mechanical ways, such as by supporting the mentioned rear part with the help of wedge-shaped pieces and by moving the wedges with an axial movement of the drill rod or the casing tube and/or with their rotation when the wedges move the rear part into the desired, deviated position.

The invention claimed is:

1. A method for controlling a direction of a drilling device which drills a hole into a ground wherein a hammering and rotatable bit is used as the drilling bit and the drilling device comprises coupled with the bit a hammering device behind the bit wherein a rear part of the hammering device is positioned in the drilled hole or inside a casing tube which covers the drilled hole in a free space so that there is space for the rear part to move radially within the drilled hole and that a location of the bit in the ground during the drilling is observed based on data received from a plurality of position sensors which indicate the location of the bit, wherein in the method the direction of the drilling is controlled by adjusting only the position of the rear part in relation to a centre line of the drilling device by adjusting a drill rod to rotate a support element which is located in the drilled hole or at an inner surface of the casing tube to position a hole defined in the support element such that the hole is deviated from the centre line or located on the centre line, said drill rod is adjusted at a feed end of the drilling device and wherein a direction angle is formed only for the bit and for the hammering device in relation to the centre line and that an impact which is directed to the bit is formed on a front side of the support element and the impact is directed in the direction of the bit onto the surface to be drilled.

2. The method according to the claim 1, wherein the drill rod passes through and rotates within the hole defined in the support element.

3. The method according to the claim 1, wherein the support element comprises a first part and a second part, the first part being rotatable within the drilled hole or the casing tube, the second part defining the hole of the support element and being lockable into the first part, the second part being radially adjustable within a space defined in the first part upon which the rear part of the hammering device rests.

4. The method according to the claim 3, wherein the first part of the support element rests on the drilled hole or the casing tube and is rotated during the drilling.

5. The method according to the claim 3, wherein the second part of the support element is locked into the space defined in the first part of the supporting element by moving the second part axially into the space of the first part and rotating the second part within the hole to engage shoulders formed on the second part with grooves formed on the first part.

6. The method according to the claim 1, wherein rotation of the support element adjusts the rear part of the hammering device to be on the centre line of the drilling device.

7. The method according to the claim 1, wherein rotation of the support element adjusts the rear part into a position which deviates from the centre line in which position the centre of the rear part moves in a circular orbit around the centre line of the drilling.

8. The method according to the claim 1, wherein rotation of the support element adjusts the rear part into a desired angle position which deviates from the centre line in which position the centre of the rear part is kept until the direction of the drilling is controllably adjusted.

9. The method according to the claim 1, wherein the direction of the drilling device is controlled by changing an impact strength of the bit or the rotating speed and the changing is performed when the rear end of the hammering device is located in a position that deviates from the centre line.

10. The method according to the claim 1, wherein the position of the rear part in relation to the centre line and to angle positions which deviate therefrom are adjusted when the movements of the drill rod or the casing tube directed in an axial direction and the rotations chosen for the drill rod or the casing tube are being combined.

* * * * *